US008351177B2

(12) United States Patent
Weed

(10) Patent No.: US 8,351,177 B2
(45) Date of Patent: Jan. 8, 2013

(54) METHOD AND APPARATUS FOR DISCHARGING A LIFTING MAGNET

(76) Inventor: Michael Allen Weed, Spring Valley, MN (US)

( * ) Notice: Subject to any disclaimer, the term of this patent is extended or adjusted under 35 U.S.C. 154(b) by 0 days.

(21) Appl. No.: 12/927,863

(22) Filed: Nov. 29, 2010

(65) Prior Publication Data

US 2012/0134064 A1 May 31, 2012

(51) Int. Cl.
*H01H 47/22* (2006.01)
*H01H 47/32* (2006.01)

(52) U.S. Cl. ..... 361/139; 361/143; 361/144; 361/156

(58) Field of Classification Search ..... 361/139, 361/143, 144, 156
See application file for complete search history.

(56) References Cited

U.S. PATENT DOCUMENTS

| | | | | |
|---|---|---|---|---|
| 5,023,539 | A * | 6/1991 | Miller et al. | 322/28 |
| 5,055,961 | A * | 10/1991 | Wiblin et al. | 361/154 |
| 7,064,942 | B2 * | 6/2006 | Ker et al. | 361/56 |
| 7,495,879 | B2 * | 2/2009 | Thexton et al. | 361/144 |
| 7,605,570 | B2 * | 10/2009 | Liu et al. | 323/207 |
| 7,876,539 | B2 * | 1/2011 | Tharp | 361/42 |
| 8,000,078 | B2 * | 8/2011 | Maraval | 361/144 |

* cited by examiner

*Primary Examiner* — Rexford Barnie
*Assistant Examiner* — Zeev V Kitov

(57) ABSTRACT

A method for discharging an industrial lifting magnet quickly without producing a high voltage transient is presented. Most of the stored magnetic energy is dissipated in the magnet itself by connecting a diode across the magnet in the appropriate direction at discharge time using switching devices. One variation, suitable for smaller magnets, discharges the remaining energy using DC capacitors and a diode switching network. Another variation, suitable for magnets of any size, discharges most of the remaining energy in a power resistor of modest size using a system of diodes and switching devices in conjunction with a relatively small AC capacitor across the magnet.

5 Claims, 2 Drawing Sheets

FIGURE 1. DISCHARGE CIRCUIT FOR SMALL MAGNETS
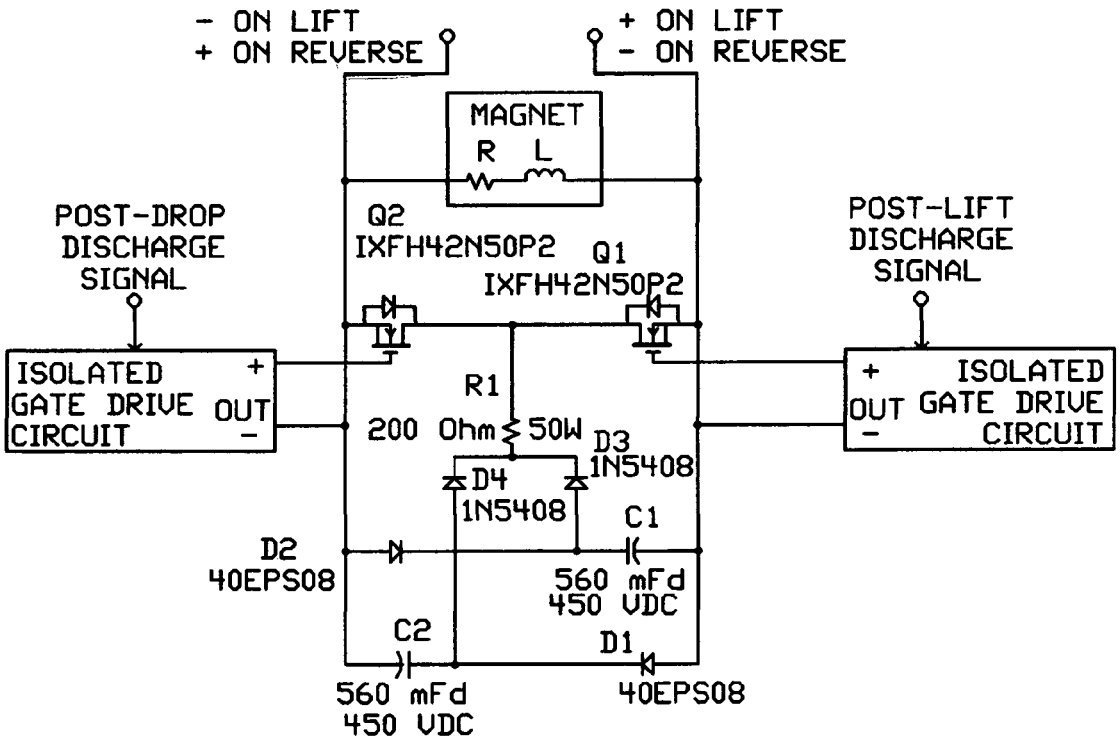

FIGURE 2. DISCHARGE CIRCUIT FOR MAGNETS OF ANY SIZE
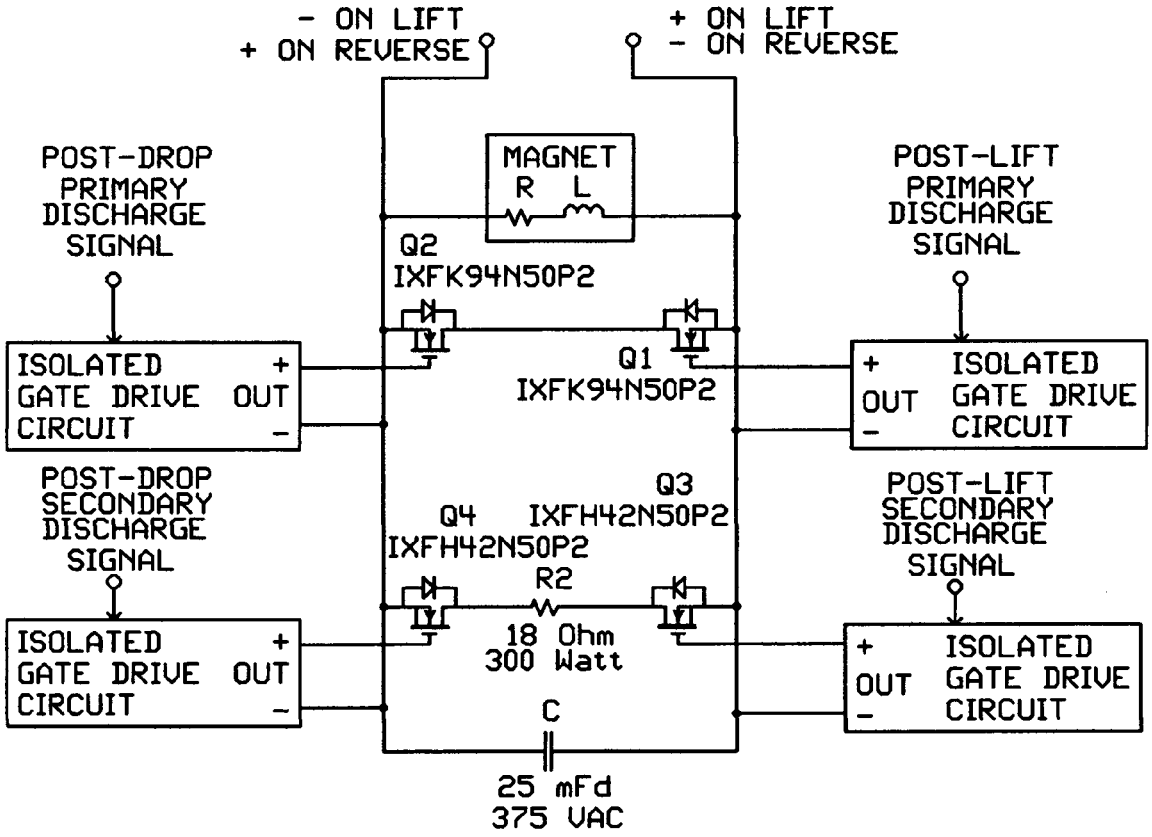

METHOD AND APPARATUS FOR DISCHARGING A LIFTING MAGNET

CROSS-REFERENCE TO RELATED APPLICATIONS

The previous application number was 12/927,863.

STATEMENT REGARDING FEDERALLY SPONSORED RESEARCH OR DEVELOPMENT

This invention was not made under Federally sponsored research or development.

REFERENCE TO SEQUENCE LISTING, A TABLE, OR A COMPUTER LISTING COMPACT DISC APPENDIX

Not applicable.

BACKGROUND OF THE INVENTION

A direct current (DC) or rectified alternating current (AC) is applied to an electromagnet attached by mechanical means to a boom to attract and hold ferrous metals. The magnet is then moved to another location and the current is removed from the magnet coil to release the metal. However, the magnet core is not completely demagnetized when all the current is removed, so some amount of current must be applied for some period of time in a direction opposite to the original current flow to release all the metal. This results in a "clean drop".

Originally, a mechanical contact arrangement was employed to apply and reverse the magnet current. These contacts were expensive and needed frequent replacement. Solid-state switching devices have been used more recently to drive current in one direction for the "lift" phase, then in the other direction for the "reverse" phase. This requires solid-state devices of high current carrying capacity and capable of withstanding the voltages involved, usually 230 Volts DC. A small magnet may draw 15 Amperes while a large magnet may draw 80 Amps or more.

An industrial lifting magnet has an inductance L and a resistance R. The resistance and inductance are distributed throughout the length of the coil, but the magnet is electrically equivalent to a resistance in series with a purely inductive element. If a magnet having initial current I(0) is shorted out, the current as a function of time is $I(t)=I(0)\exp(-Rt/L)$. In other words, the current in a magnet has a characteristic period of L/R. The value of L/R for industrial lifting magnets is typically about 0.5 seconds A problem occurs when the current in the magnet coil is reduced or cut off. The collapsing magnetic field in the inductor produces a current that must be discharged through an external impedance. The current through this impedance can produce a voltage transient that can be very large, and will damage semiconductor switching devices if not controlled.

It is well known that the voltage transient caused by reducing the current in an inductor can be suppressed by placing a "flyback diode" across the inductor, but such a diode cannot be permanently connected across a lifting magnet because it would short out the power supply when the applied voltage is reversed.

One means of mitigating this problem, if power is supplied by a DC generator, is to reverse the field of the DC generator and thereby reverse the output. But the generator field is also an inductor, so transient suppression is still required, and reversing the field results in a demagnetization time that is unacceptably long.

Most relevant related U.S. Patents:

U.S. Pat. No. 4,306,268—Essentially an H bridge with relays for switching a DC source, but had a forward flyback diode in series with resistors permanently connected across the magnet, which would have conducted heavily during reverse. Another flyback diode for reverse, again in series with a resistor, was switched in using relays. Voltage drop on these resistors represented the decaying current in the magnet, and when the current was low enough, reverse voltage from the DC source began flowing into the magnet via a diode that kept the source isolated from the magnet up to that point. But voltages reached up to 1000 V, and there must have been severe arcing in the relay contacts.

U.S. Pat. No. 4,600,964—A design using two magnet coils, one for lift and one for drop. This used full-wave rectified output from an AC generator, which was switched between lift and drop coils using relays. The main problem with this invention is that magnets are expensive, and most magnets already in the field have only one coil. Flyback diodes on each coil are necessary to prevent arcing when the relay contacts are opened. Furthermore, flyback diodes alone without a secondary discharge would discharge the magnet too slowly.

U.S. Pat. No. 5,325,260—This design used an AC generator that was connected to a standard bridge rectifier via mechanical relay contacts. The rectified AC from the bridge was applied to the magnet using mechanical relays in a standard H bridge configuration. Before the lift or drop relay contacts were opened, the relay contacts feeding the standard rectifier bridge were opened, thus causing the H bridge rectifiers to act like flyback diodes. This reduced the stored magnetic energy before the lift or drop contacts opened, and would reduce the high voltage arcing to some extent. But there was no secondary discharge circuit as in the present invention, and no capacitor across the magnet, which means either there was a large high voltage transient or a relatively long time was required to reverse the magnet current. Special mercury-wetted relay contacts were required because of the contact arcing.

U.S. Pat. No. 7,495,879—A solid state design that used insulated gate bipolar transistors (IGBTs) in an H bridge configuration and a DC power source. The stored magnetic energy at the end of a lift or drop was fed into a large capacitor, then the capacitor was discharged through a fifth IGBT and resistor. To avoid excessive high voltage, the capacitor must have been very large and must have had a rather high voltage rating. The stored magnetic energy was dissipated in a resistor, not the magnet, so the resistor must have been of high wattage rating, and therefore of large physical size and must have required a large heat sink.

U.S. Pat. No. 7,697,253—Another solid-state control using a DC generator and an H bridge configuration. This design allegedly dissipated the stored magnetic energy in the DC generator and a resistor in series with a transient voltage supressor (TVS), not in the magnet resistance. This would produce some extra wear on the generator, and would have required a very large TVS to withstand twice the lifting current for at least several tenths of a second.

SUMMARY OF THE INVENTION

Magnet controllers use DC or rectified AC voltage to drive current through the magnet in one direction for "lift", then in the opposite direction ("reverse") to remove the remaining magnetism after the lift current is removed. The lift and reverse currents may be applied by a variety of means, such as an H bridge for a DC source, or thyristors that apply rectified AC in the desired direction. No matter how the voltage is applied, the magnet current must be reduced at the end of the lift phase and then reversed. Reducing the current fast enough for practical magnet operation can produce a high voltage transient. This transient must be eliminated or significantly reduced to prevent damage to semiconductor switching elements.

The fastest way to discharge a magnet without a high voltage transient is to connect a variable impedance across the magnet when the external power is disconnected, then vary the impedance to keep the voltage at its maximum allowable value until the discharge is complete. The initial value of the impedance must be near zero, and then increased to a very high value at the end of the discharge, at which point the voltage across the magnet quickly drops to zero. The word "transistor" is defined as such a variable impedance that can be controlled by an electrical signal. However, a transistor used to discharge an industrial lifting magnet in this manner would have to be capable of dissipating a large amount of power, and would be prohibitively expensive.

The present invention approximates the ideal discharge impedance in a stepwise fashion that still discharges the magnet fast enough, avoids a high voltage transient and is inexpensive. Two flyback diodes are connected across the magnet in opposite directions via switches. The switches can be semiconductors such as field effect transistors (FETs), insulated gate bipolar transistors (IGBTs) or the like. Since they are used as switches (either "on" or "off"), these devices do not need to handle a large amount of power. When "off", there is no current through the device, hence no power is dissipated. When "on", there is little voltage across the device, and again little power is dissipated. During the lift phase, one diode is switched across the magnet in the reverse-biased direction, so it does not conduct, and the other diode is switched out of the circuit. When the lift voltage is removed, the diode that is connected across the magnet becomes forward-biased to the current sourced by the magnet, and discharges the magnet at a low voltage. When the magnet is sufficiently discharged, the lift phase diode is switched out of the circuit, the reverse phase diode is switched in and the reverse voltage is applied. This diode remains in the circuit for some time after the reverse voltage is removed, thereby discharging the magnet after the reverse phase.

This method dissipates most of the stored magnetic energy in the magnet itself during discharge. Magnets are designed to dissipate this amount of power, so there is little additional cost associated with this method. A capacitor is permanently connected across the magnet which prevents a high voltage transient when the discharge diodes are disconnected. The capacitor briefly accumulates charge from the small amount of remaining discharge current, then this charge flows through the magnet resistance until the capacitor is discharged. Since the capacitor is connected across the magnet, and the magnet voltage must be reversed, the capacitor must be an AC type, not polarized. AC capacitors of more than a few tens of microfarads with a sufficient voltage rating are expensive and bulky. An alternative to a single AC capacitor consisting of two polarized (DC) capacitors, four diodes and a resistor is shown that provides an effective capacitance of several hundred microfarads in this application, is inexpensive and relatively small in size.

The above sequence will discharge a small magnet in an acceptable period of time, but larger magnets require a secondary discharge phase before the current is fed into the capacitor if the magnet is to be discharged quickly. The secondary discharge method uses a second set of switches that connect a resistor across the magnet to effect the secondary discharge. A relatively small AC capacitor is connected across the magnet in this method. The mathematical analysis that shows how these discharge methods work is given below.

The voltages between the various semiconductor elements are at widely different values during operation, so an isolated signal is needed to drive each switch. A standard integrated circuit that is widely available is used for this purpose in the present invention. In addition to being isolated, the switch driver must change the switch between "on" to "off" states quickly to avoid excessive power dissipation in the switching device, and must firmly hold the switching device in the "off" state to prevent inadvertent turn-on caused by extraneous signals.

The signals that control the switches may be provided by a variety of means, such as a programmable logic controller or a microprocessor. The methods by which the control signals are derived are well known to those skilled in the art of magnet controller design.

BRIEF DESCRIPTION OF THE DRAWINGS

FIG. 1 shows the circuit for discharging the stored magnetic energy suitable for magnets drawing less than about 20 Amps.

FIG. 2 shows the circuit for discharging the stored magnetic energy suitable for magnets of any size. The resistor R2 should be about 5 or 6 times the magnet's resistance.

DETAILED DESCRIPTION OF THE INVENTION

It is to be understood that the present disclosure is an exemplification of the principles of the invention and does not limit the invention to the illustrated embodiments.

No voltage is applied to the magnet in the initial state, the magnet is fully discharged, and the switches controlling the flyback diodes are off. In the discharge circuit of FIG. 1 the capacitors C1 and C2 are fully discharged. In the discharge circuit of FIG. 2 the capacitor C3 is fully discharged and the second set of switches shown as Q3 and Q4 are off. The switches are FETs in the preferred embodiment, as shown in the drawings. The operator signals the controller for a "lift" by, for example, pressing a pushbutton. The control circuit responds by applying voltage to the magnet in the "lift" direction. Ideally, the switch controlling the "lift" flyback diode is turned on at this time. This switch is shown as Q1 in the drawings, and the flyback diode for "lift" is the body diode of Q2. The power source is not shorted out because the flyback diode is reverse-biased.

The current in the magnet builds up to its maximum value $I(0)=V/R$ for applied voltage V and magnet resistance R and attracts the load. Capacitor C1 in FIG. 1 remains discharged because diodes D2 and D3 are reverse-biased. Capacitor C2 in FIG. 1 is charged up to near the applied voltage V through diode D1. Capacitor C in FIG. 2 is charged up to voltage V because it is directly across the magnet. The operator moves the magnet to the drop location and signals the controller to release the load, for example, by pressing a pushbutton. At this time the controller disconnects the "lift" voltage. The "lift" flyback diode must be switched in at or before this time, and the discharge current flows through the body diode of Q2. There is no high voltage transient because of the low impedance across the magnet formed by the series connection of Q1, which is turned on, and the forward-biased body diode of Q2. The current decays according to $I(t)=I(0)\exp(-Rt/L)$, and decays to I1=0.1361(0) after one second if L/R=0.5 second. The stored magnetic energy is dissipated in the magnet's resistance, and because the stored magnetic energy is proportional to the square of the current, approximately 98% of the energy is dissipated in this one second interval. All charged capacitors are discharged to near zero volts during this time.

Capacitor C2 in FIG. 1 is discharged through R1, Q1 and the magnet resistance R. Resistor R1 is included to limit the discharge current from C2. Capacitor C1 in FIG. 1 remains discharged because the voltage across the series combination of D2 and C1 is near zero during this time. Capacitor C in FIG. 2 discharges through the magnet resistance R. Q1 is turned off at the end of the one second interval, but some magnetic energy remains in the magnet and the magnet is still producing a current I1. With the magnet power and flyback diodes turned off, the magnet and capacitor C1 in FIG. 1 (ignoring the small effect of the forward-biased diode D2) form a series LRC circuit. Q1 is turned off, diodes D1, D3 and D4 are reverse-biased, so these diodes and R1 and C2 are effectively disconnected from the rest of the circuit. The sum of the voltages around the closed LRC loop formed by the magnet and C1 is zero. If Q is the charge on C1, the circuit equation is (using C in place of C1) LdI/dt+RdQ/dt+Q/C=0 where I=dQ/dt. The solution to this second-order differential equation is Q(t)=exp(−Rt/2L)(A cos(wt)+B sin(wt)) where A and B are constants determined by the initial conditions and w=squareroot (1/LC−(R/2L)(R/2L)) radians per second (provided squareroot (LC)<2L/R, as it is for practical values of C). Here t=0 is taken as the time when Q1 is turned off. Since Q(0)=0, it must be that A=0. The current in the circuit is I(t)=dQ/dt=Bexp(−Rt/2L)(−(R/2L)sin(wt)+w cos(wt)). Hence, B=I1/w and Q(t)=(I1/w)exp(−Rt/2L)sin(wt). The voltage across the capacitor is V(t)=Q(t)/C=(I1/wC)exp(−Rt/2L)sin(wt), an exponentially damped sine wave.

For industrial lifting magnets and practical values of C, w is nearly squareroot (1/LC) and is much larger than 2L/R, and the voltage across the capacitor peaks when the argument of the sine is pi/2 radians. For example, a relatively small magnet with I(0)=20 Amps has 11=2.72 Amps. If C=560 microFarads (mFd) and L=5 Henries, the voltage peaks 83.2 milliseconds after Q1 is turned off, and the peak voltage is 257 Volts. This is less than the peak voltage of rectified AC applied during lift if an AC source is used, and only slightly higher than the 230V from a DC source. There is no high voltage transient.

However, a large magnet may have I(0)=80 Amps and I1=10.9 Amps, which, with the same C, would produce an excessive peak voltage of 1028 Volts. A better discharge circuit for larger magnets is shown in FIG. 2. The primary discharge phase was described above and ends when Q1 is turned off. Before or immediately after Q1 is turned off, switch Q3 (which is a FET in the preferred embodiment) is turned on which connects resistor R2 across the magnet via the forward-biased body diode of Q4. Switch Q3 remains on for about ½ second. If the value of capacitor C is zero, the discharge current during this time would be I(t)=I1exp(−(R2+R)t/L). The magnet discharges faster when a larger resistor is placed across it. The voltage across the magnet at the start of the discharge is I1R2. For example, if R2=18 Ohms and I1=10.9 Amps, the peak voltage would be a modest 196 Volts.

If the value of C is not zero this peak voltage is much lower. There is no high voltage transient. If the RC time constant is much less than the L/(R+R2) time constant, the presence of the capacitor does not significantly alter the exponential decay of the voltage due to L and R+R2. For example, if L/R=0.5 seconds, R=4 Ohms and R2=18 Ohms, the current in the magnet is reduced by a factor of e to the power 5.5 after ½ second. In the present example, this is I2=I1/245=0.045 Amps. During this ½ second, most of the remaining magnetic energy is dissipated in R2, which must be of sufficient wattage to handle the initial current of 10.9 Amps and the average power over the ½ second period.

At the end of the secondary discharge, Q3 is turned off and the circuit now appears as a series LRC circuit like the circuit of FIG. 1 at the end of the primary discharge, but now the initial current is much smaller, and a much smaller single AC capacitor can be used across the magnet. The capacitor voltage at this time is 0.045 Amps times 18 Ohms, or 0.81 V, which is added to the peak voltage of the exponentially decaying sinusoidal waveform. For a typical large magnet with R=4 Ohms and L=2 Henries, and using C=25 microFarads, the voltage peak occurs 10.2 milliseconds after Q3 is turned off, and the peak voltage is 13.5 Volts. There is no high voltage transient.

Once the discharge circuits are turned off after a lift, reverse voltage may be applied to the magnet without shorting out the source voltage. The very small amount of magnetic energy remaining in the magnet and discharge circuit capacitors is readily dissipated in the magnet's resistance.

The circuits of FIG. 1 and FIG. 2 are symmetric with respect to the "lift" and "reverse" voltage applied to the magnet. The discharge sequence following the "reverse" phase is identical to that of the "lift" phase, with the roles of Q1 and Q2 interchanged, the roles of Q3 and Q4 interchanged, the roles of C1 and C2 interchanged, the roles of D1 and D2 interchanged, and the roles of D3 and D4 interchanged.

I claim:

1. A magnet discharge apparatus for an electromagnet, said electromagnet being associated with a control system and power source that applies a DC or rectified AC voltage to the magnet in a "lift" direction, and then applies a DC or rectified AC voltage in the opposite, or "reverse", direction and applies control signals at specific times and for specific durations to the discharge apparatus, such discharge apparatus being comprised of:

a primary lift discharge circuit further comprised of a series combination of a first diode and a first electrically-controlled switching element, said first diode being in the reverse-biased direction during "lift", and said series combination connected in parallel across the magnet; a primary reverse discharge circuit further comprised of a series combination of a second diode and a second electrically-controlled switching element, said second diode being in the reverse-biased direction during "reverse", and said series combination connected in parallel across the magnet; a secondary lift discharge circuit; and a secondary reverse discharge circuit.

2. The secondary lift discharge circuit of claim 1, comprised of a first capacitor of the AC type in parallel with the magnet and a series combination of a third electrically-controlled switching element in series with a resistor in series with a third diode, said third diode being in the reverse-biased direction during "lift", and said series combination being connected in parallel across the magnet.

3. The secondary reverse discharge circuit of claim 1, comprised of a series combination of a fourth electrically-controlled switching element in series with a resistor in series with a fourth diode, said fourth diode being in the reverse-biased direction during "reverse", and said series combination being connected in parallel across the magnet and in parallel with the first capacitor of claim 2.

4. A secondary lift discharge circuit of claim 1, comprised of fifth and sixth diodes, a second capacitor of the DC type and a resistor, said fifth diode having its anode connected to the side of the magnet that is at a negative voltage during lift and its cathode connected to the positive side of said second capacitor, and the negative side of said second capacitor connected to the side of the magnet that is at a positive voltage during lift, and said sixth diode having its anode connected to the junction of said fifth diode and said second capacitor, and its cathode connected to the resistor, and said resistor having its other end connected to the junction of the first diode and first switching element of claim 1 to effect a current-limited discharge of the said second capacitor during the time that the first switching element is turned on.

5. A secondary reverse discharge circuit of claim 1, comprised of seventh and eigth diodes, a third capacitor of the DC type and a resistor, said seventh diode having its anode connected to the side of the magnet that is at a negative voltage during reverse, its cathode connected to the positive side of said third capacitor, and the negative side of said third capacitor connected to the side of the magnet that is at a positive voltage during reverse, and said eigth diode having its anode connected to the junction of said seventh diode and said third capacitor, its cathode connected to the resistor, and said resistor having its other end connected to the junction of the second diode and second switching element of claim 1 to effect a current-limited discharge of said third capacitor during the time that the second switching element is turned on.

* * * * *